US005360316A

United States Patent [19]

O'Mara et al.

[11] Patent Number: 5,360,316

[45] Date of Patent: Nov. 1, 1994

[54] FLATS PIECES SINGULATION APPARATUS

[75] Inventors: Kerry D. O'Mara, Florence Township, Burlington County; Christopher J. Poux, Hamilton Township, Mercer County; Ross M. Carrell, Cinnaminson Township, Burlington County; Kurt R. Grice, East Brunswick Township, Middlesex County, all of N.J.

[73] Assignee: David Sarnoff Research Center, Inc., Princeton, N.J.

[21] Appl. No.: 812,786

[22] Filed: Dec. 23, 1991

Related U.S. Application Data

[63] Continuation-in-part of Ser. No. 626,595, Dec. 12, 1990, abandoned.

[30] Foreign Application Priority Data

Apr. 7, 1990 [GB] United Kingdom ..... 9007921.1

[51] Int. Cl.[5] ..... B65H 5/06

[52] U.S. Cl. ..... 414/798.9; 198/530; 198/539; 271/126; 271/150

[58] Field of Search ..... 198/406, 409, 530, 539, 198/560; 271/126, 129, 149, 150, 198, 200, 302; 414/798.9

[56] References Cited

U.S. PATENT DOCUMENTS

| | | | |
|---|---|---|---|
| 2,988,355 | 6/1961 | Rabinow et al. | 271/2 |
| 3,511,368 | 5/1970 | Kajitani et al. | 209/73 |
| 4,078,672 | 3/1978 | Crepaldi et al. | 414/798.9 |
| 4,177,982 | 12/1979 | Bewersdorf et al. | 271/150 |
| 4,265,361 | 5/1981 | Schroeder | 209/617 |
| 4,359,304 | 11/1982 | Trudeau | 414/798.9 |
| 4,570,801 | 2/1986 | Brannen | 414/798.9 |
| 4,607,833 | 8/1986 | Svyatsky et al. | 271/10 |
| 4,613,268 | 9/1986 | Capdeboscq et al. | 414/798.9 |
| 4,697,689 | 10/1987 | Carrell | 198/394 |
| 4,756,399 | 7/1988 | Scata | 198/369 |
| 4,777,365 | 10/1988 | Torii et al. | 271/149 |
| 4,813,838 | 3/1989 | Santeusanio | 414/798.1 |
| 4,928,946 | 5/1990 | Svyatsky et al. | 271/10 |

OTHER PUBLICATIONS

Davis et al. "Intelligent Letter Mail Singualtion" in U.S. Postal Service Third Advanced Technology Conference, Mar. 3–5, 1988.

*Primary Examiner*—Michael S. Huppert
*Assistant Examiner*—Janice L. Krizek
*Attorney, Agent, or Firm*—W. J. Burke

[57] ABSTRACT

A flats singulation apparatus includes a input buffer section having a substantially horizontal ramp which is adapted to support thereon a stack of flats mailpieces on edge. The buffer section includes a moving belt and ram plate for moving the stack of flat pieces toward the front end of the ramp. A transfer section is at the end of the ramp and is adapted to remove the flat pieces substantially one at a time from the ramp and drop them downwardly. The transfer section includes a plurality of edge rollers extending across the end of the ramp and adapted to move the flat pieces from the stack, and a ledge plate extending downwardly from the edge rollers and having a horizontal ledge onto which the flat pieces drop. A pusher shelf is movable across the ledge to push the flat pieces off of the shelf. A separation section extends substantially horizontally across the end of the transfer section and includes means for moving the flat pieces away from the transfer section and separating flat pieces.

21 Claims, 13 Drawing Sheets

FLATS PIECES SINGULATION APPARATUS

STATEMENT AS TO RIGHTS TO INVENTIONS MADE UNDER FEDERALLY-SPONSORED RESEARCH AND DEVELOPMENT

This U.S. Postal Service has rights in this invention under Contract No. 104230-D-2154.

CROSS-REFERENCE TO RELATED APPLICATIONS

This application is a continuation-in-part of U.S. patent application Ser. No. 07/626,595, filed Dec. 12, 1990, now abandoned.

FILED OF THE INVENTION

The present invention relates to an apparatus for singulating flats, and more particularly, to an apparatus for singulating various types of flats mail.

BACKGROUND OF THE INVENTION

In the United States Post Office, mail is separated and sorted by zip code for delivery to the appropriate location that the mail is intended. In order to speed up this sorting operation it is desirable to have apparatus which automatically delivers the pieces of mail, one at a time, to an operator who reads the zip code on the pieces of mail and inputs the zip code into the apparatus for sorting the mail by the zip code. Apparatus has been developed for reading and sorting certain types of mail, particularly flat mail which is completely enclosed in an envelope and within certain sizes of envelopes. However, there is a large category of flats mail which cannot be handled by presently used automatic sorting apparatus and must be sorted manually. This type of mail includes such things as magazines or similar items which are open along one or more sides, relatively thick flat packages, and flats mail of various sizes and shapes. A major problem in handling these types of flats mail is in feeding the mail pieces, one at a time, to the sorting apparatus. In the United States-Post Office mail is transported in standardized corrugated plastic tray. It is necessary to take a stack of mail, which may include various types and sizes of flats mail, and separate the pieces of mail, one at a time, from the stack and then feed the individual pieces to a sorting apparatus. However, because of the different types and sizes of the mail pieces in a stack, it has not been possible to do this successfully with automatic apparatus. Therefore, it is desirable to have an apparatus which will separate the individual pieces of mail from a stack containing various kinds of flats mail and deliver the pieces, one at a time, to a sorter or other handling apparatus.

SUMMARY OF THE INVENTION

The present invention relates to an apparatus for singulating flats pieces of various types and sizes which comprises a substantially horizontal input buffer section for supporting a stack of flats pieces which are seated on one edge. Means are provided for moving the stack of flats pieces toward one end of the buffer section. At the end of the buffer section is a transfer section for removing the pieces substantially one at a time from the end of the stack and dropping the pieces downwardly. A separation section below the transfer section is adapted to receive the pieces and carry the mailpieces away one at a time.

BRIEF DESCRIPTION OF THE DRAWINGS

A component of the apparatus of the invention has the same numerical designation in all the FIGS.

DETAILED DESCRIPTION

The invention is an apparatus for singulating, i.e. separating, flats mail of various types and sizes which comprises a substantially horizontal input buffer section for supporting a stack of flats mailpieces which are seated on one edge. Means is provided for moving the stack of mail toward one end of the buffer section. At the end of the buffer section is a transfer section for removing the mail pieces substantially one at a time from the end of the stack and dropping the mail pieces downwardly. A separation section below the transfer section is adapted to receive the mailpieces and carry the mailpieces away one at a time. The invention includes several different embodiments of the separation section. This invention is equally applicable to the separation of other types of flat pieces and it is to be understood that where the terms flats, flats mail or mailpieces are used, these terms also include other types of flat pieces.

Figure 1:
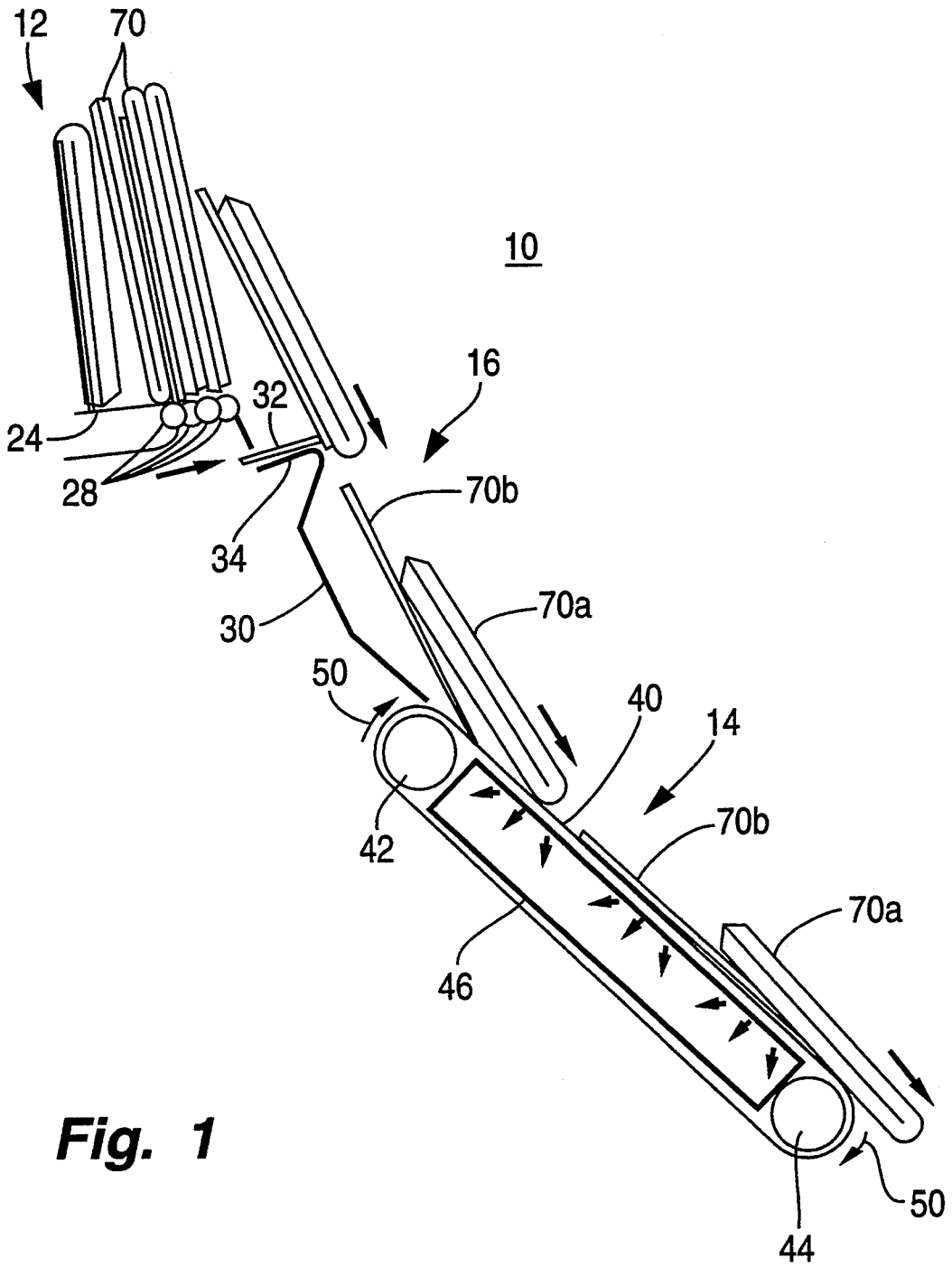
FIG. 1 is a schematic side view showing the first three sections, the input buffer section, the transfer section and the transport section, of the singulator system of the present invention.
Figure 12:
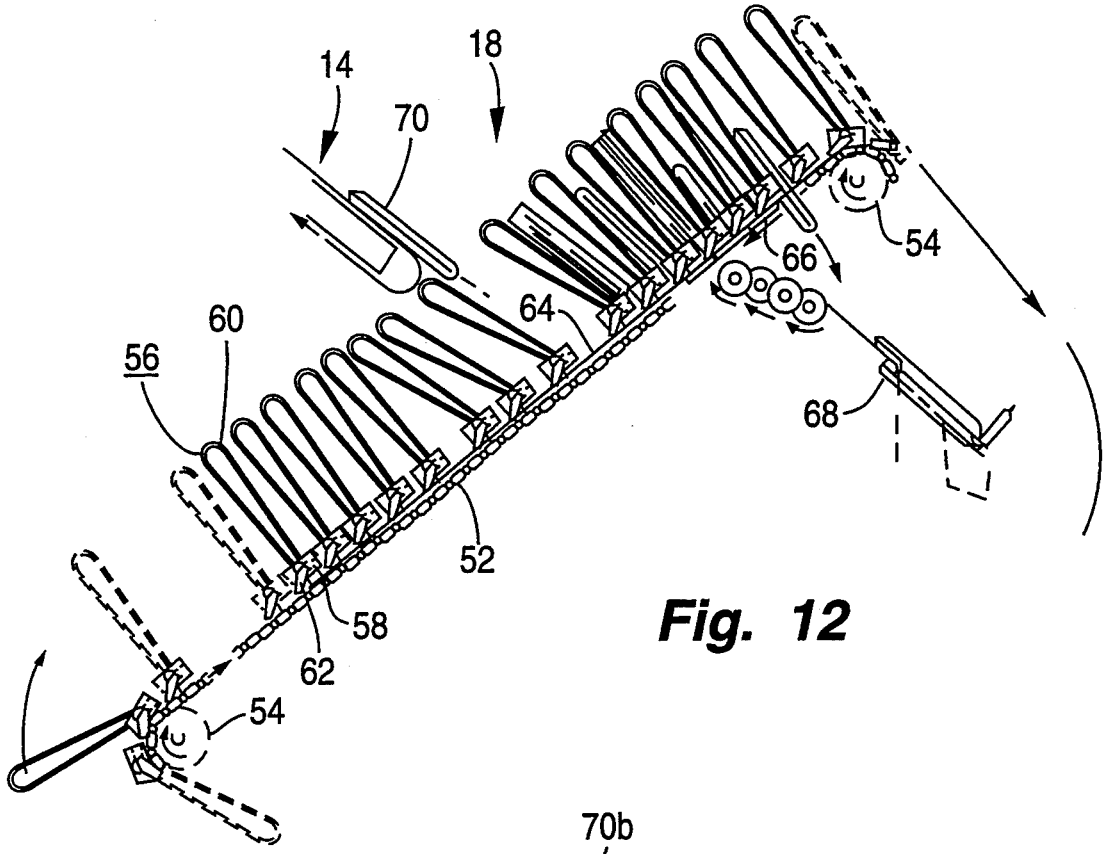
FIG. 12 is a schematic side view of the separation section of the system.

Referring initially to FIG. 1, there is shown a portion of a first embodiment of a flats mail singulation system 10 of the present invention. Singulation system 10 includes an input buffer section 12 feeding to a transport section 14 through a transfer section 16. As shown in FIG. 12, the transport section 14 feeds to a separation section 18.

Figure 2:
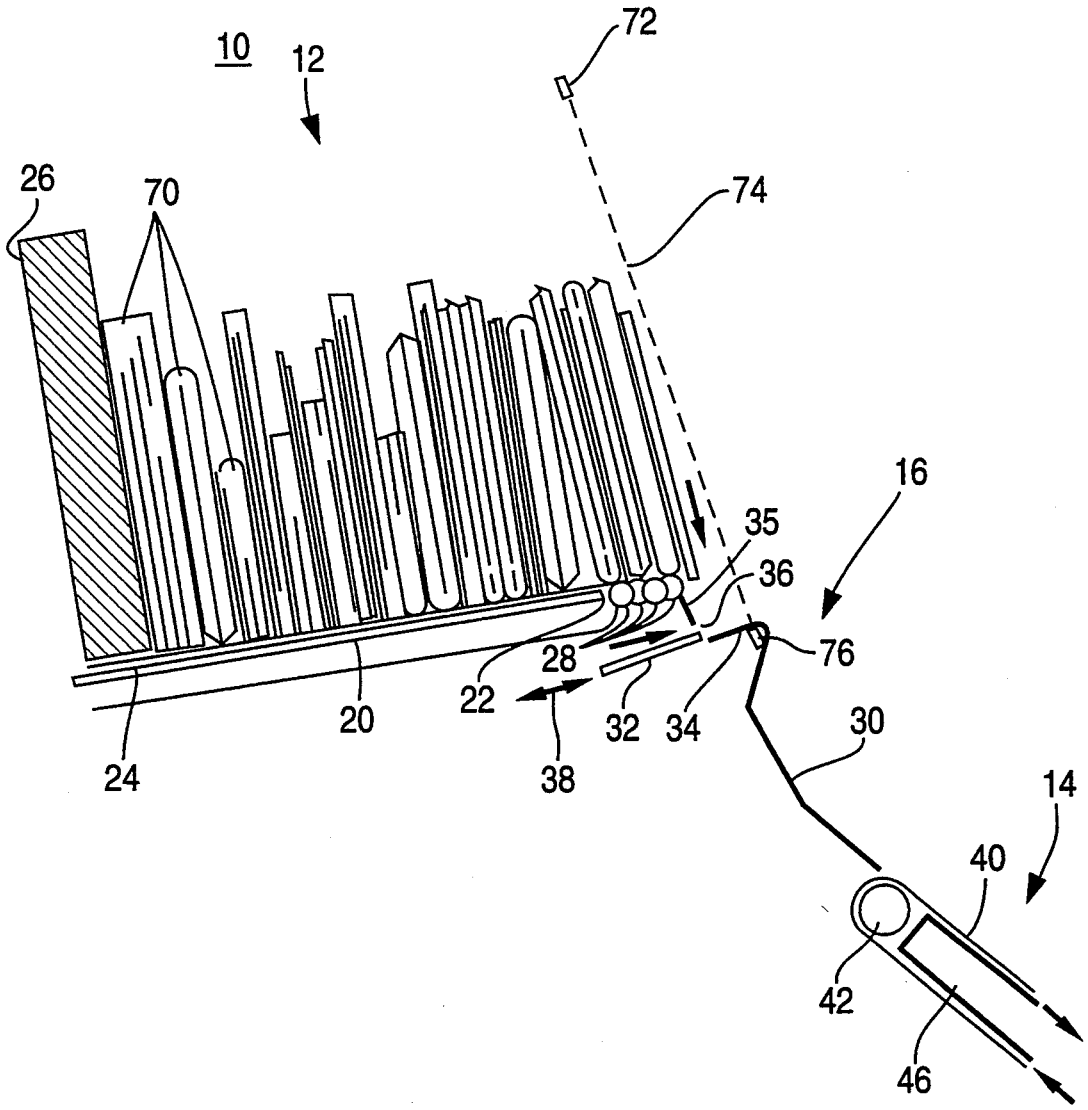
FIG. 2 is an enlarged side view of the input buffer section and the transfer section.

As shown in FIG. 2, the input buffer section 12 includes a ramp 20 that is inclined by about 15° upwardly from the horizontal from its back end to it forward end 22. Extending over the upper surface of the ramp 20 and across its forward end 22 are a plurality of continuous belts 24 which are spaced apart across the width of the ramp 20. The belts 24 extend around drive shafts (not shown), one of which is at the forward end 22 of the ramp 20. A ram plate 26 is mounted in a substantially vertical position on one edge over the ramp 20 and the belts 24. The ram plate 26 is connected to means, such as a pusher rod and hydraulic cylinder or a jack screw and ball nut (not shown), for moving the ram plate 26 incrementally along the ramp 20 towards the forward end 22 of the ramp 20 and then back again toward the back end of the ramp 20. The belts 24 and the ram plate 26 are adapted to be driven along the ramp 20 at substantially the same rate of speed.

Figure 18:
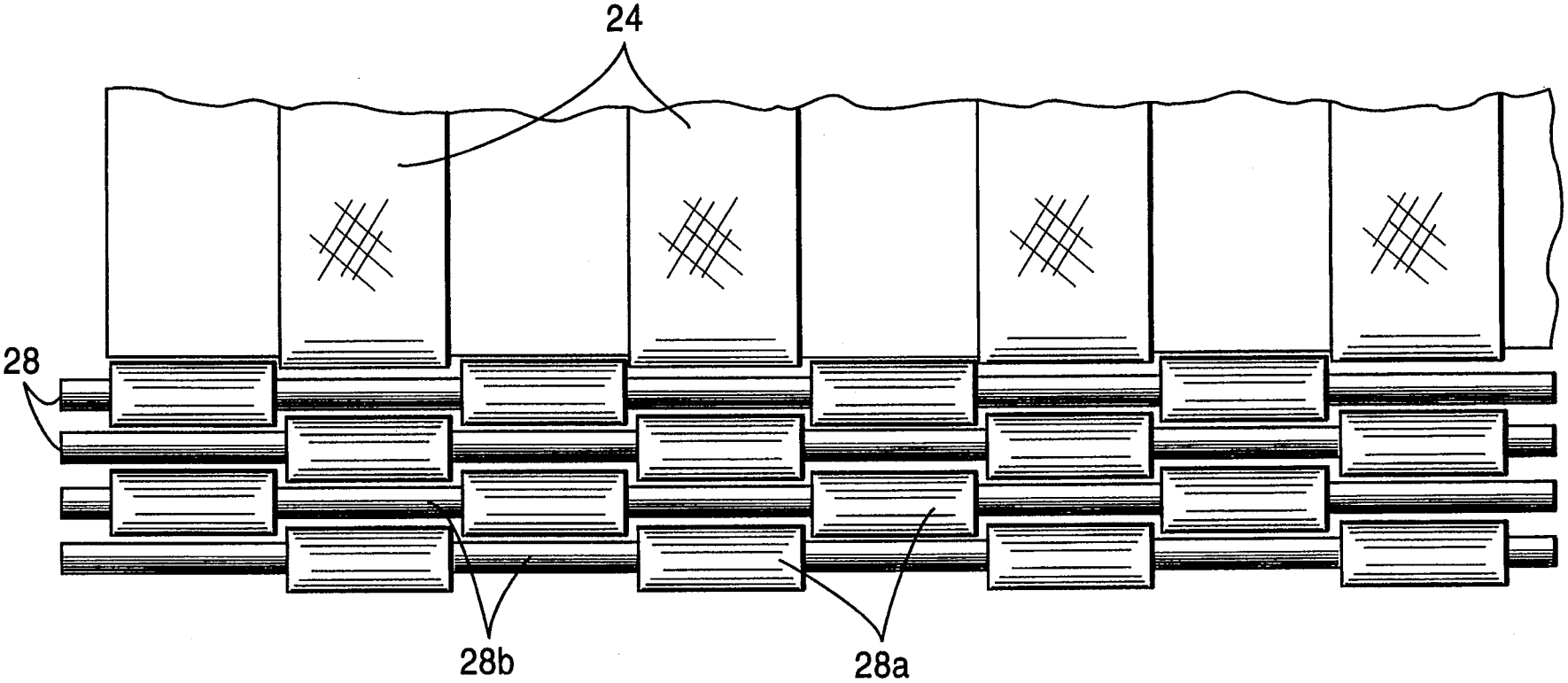
FIG. 18 is a top plan view of the edge rollers at the end of the input buffer section.

At the forward end 22 of the ramp 20 is a set of four singulation edge rollers 28. The edge rollers 28 extend transversely across the forward end 22 of the ramp 20 and have axes of rotation which lie on a plane extending from the forward end 22 of the ramp 20. Each edge roller 28 is an assembly of alternating larger and smaller diameter segments **28*a* and 28*b* along a shaft as shown in FIG. 18. The larger diameter segments 28*a* are of natural latex rubber rollers about 0.450 inches in diameter and about one inch long. The larger diameter roller segments 28*a* are spaced slightly more than one inch apart along the shaft. The rollers 28 are positioned with respect to each other so that the larger diameter segments 28*a* of each roller are adjacent the smaller diameter segments 28*b* of the adjacent roller(s) 28. Thus, the larger diameter segments 28*a* of each roller 28 interleave with the larger diameter segments 28*a* of the adjacent rollers 28 and thereby provide an overlap between the rollers 28. The drive belts 24 are of a width and are spaced apart so as to extend into the spaces between the larger diameter segments of the roller 28 adjacent the forward end 22 of the ramp 20 so that the drive belts interleave with the first edge roller 28. Thus, the belt-to-roller interface and the roller-to-roller interface are interleaved to ensure that no straight gaps exist. Each of the edge rollers 28 is driven by a separate stepper motor (not shown) with the stepper motors being controlled by a computer. This permits the speed of each of the edge rollers 28** to be individually controlled.

The transfer section 16 includes a ledge plate 30 and a pusher shelf 32. The ledge plate 30 extends substantially vertically downwardly from and along the length of the forwardmost edge roller 28. The ledge plate 30 has a short ledge 34 which extends substantially parallel to the plane of the edge rollers 28 and is positioned below and forward of the forwardmost edge roller 28 and a short vertical section 35 which extends upwardly from the ledge 34 to the edge rollers 28. The ledge plate 30 has an opening 36 through the vertical section 35 at the upper surface of the ledge 34. The pusher shelf 32 is a flat plate which is positioned parallel to and above the upper surface of the ledge 34. The pusher shelf 32 is mounted to move back and forth through the opening 36 and across the ledge 34 as indicated by the double headed arrow 38. The pusher shelf 32 is connected to means for selectively moving it back and forth, such as a pneumatic cylinder or a stepper motor. The operating means for the pusher shelf 32 is also controlled by the computer.

The transport section 14 extends downwardly and slightly forwardly from the end of the ledge plate 30. The transport section 14 includes an endless transport belt 40 extending between and around a pair of spaced drive pulleys 42 and 44. The transport belt 40 is preferably formed of several closely spaced belts arranged with a small spacing between the edges of adjacent belts. For example, the belts may be two inches wide with a one-eighth inch spacing between the belts. However, the transport belt 40 can be a one piece belt having perforations therethrough. Behind the upper portion of the transport belt 40 is a vacuum plenum 46 having perforations in its upper surface 48 along which the transport belt 40 extends and connected to a suitable source of vacuum. At least one of the pulleys 42 and 44 is connected to a drive means which moves the upper portion of the transport belt 40 downwardly as indicated by the arrows 50.

Referring to FIG. 12, the separation section 18 extends across the bottom of the transport section 14. The separation section 18 includes an endless chain 52 which extends in a closed path around a plurality of pulleys 54, only two of which are shown. The portion of the path of the chain 52 between the two pulleys 54 shown is in an upward direction across the end of the transport section 14. Mounted on a track, not shown, which extends along the chain 52 are a plurality of separators 56. Each of the separators 56 comprises a base 58 which rides on the track, and a flexible vane 60 projecting from the base 58 away from the chain 52. Each base 58 has a ratchet pin 62 which is adapted to engage the chain 52 so that the separator 56 will move with the chain 52. A cam plate 64 extends along a portion of the chain 52 between the two pulleys 54 shown and across the end of the transport section 14. The cam plate 64 is adapted to engage the ratchet pins 62 of the bases 58 to disengage the separators 56 from the chain 52. A mechanism, not shown, is provided along the sides of the bases 58 of the separators 56 when the separators 56 reach a position under the end of the transport section 14 to move the separators 56 along the path of the chain 52 faster than the speed of movement of the chain 52. At the upper end of the cam plate 64 is a sliding gate 66 which is adapted to move aside and allow mail pieces to drop downwardly from between the separators 56 to a transport device 68 which carries the mail pieces to other apparatus, such as a sorting machine.

In the operation of the singulation system 10, a stack of flats mailpieces 70 is placed on the ramp 20 of the input buffer section 12 with each mailpiece 70 being substantially vertical and seated on an edge. As shown in FIG. 2, the stack can contain mailpieces 70 of various sizes, thickness and kinds of flats mail. The ram plate 26 is moved against the back of the stack so that the stack leans back to a stable position against the ram plate 26.

The belts 24 and the ram plate 26 are then operated to move the mailpieces 70 toward the forward end 22 of the ramp 20 and to the edge rollers 28. The velocity of the belts 24 and the ram plate 26 is appropriately matched to that of the edge rollers 28. When the first mailpiece 70 reaches the rollers 28 the bottom edge of the mailpiece 70 is picked up by the first roller 28 and is carried from roller to roller. As the mailpiece 70 goes over the last roller 28, it drops downwardly to the ledge 34 of the ledge plate 30. As each on-edge mailpiece 70 goes over the rollers 28 it bumps up and down slightly. This motion has three beneficial affects. First, the motion attempts to break free or reduce the static friction between two adjacent mailpieces 70. Secondly, the edge rollers 28 being parallel with the edge of the mailpiece 70, helps to reduce small yaw angles of the front mailpiece 70. A "yaw" angle is that which can be measured when the front face of the stack of mailpieces 70 is not parallel with the singulation edge. When the two are parallel, the yaw angle is zero. Thirdly, the mailpiece motion over the rollers 28 is a slight aid in bringing all edges of the mailpieces 70 downward. It is not desirable for a mailpiece 70 to be suspended by friction between the mailpieces 70 that are in front and behind it.

As shown in FIG. 2, a topple sensor is located at the front of the face of the stack of mailpieces 70. The topple sensor comprises a source 72 of a light beam, such as a small lamp or a laser diode, mounted above the stack of mailpieces 70 and positioned to direct its beam of light downwardly across and just in front of the stack of mailpieces 70 as indicated by the dash line 74. A light detector 76, such as a semiconductor photodetector, is mounted below the bottom edge of the stack of mailpieces 70 and in the line of the light beam to receive the light beam. The output of the light detector 76 is connected to the control computer. If the upper edge of the stack face begins to tilt forward, the beam is broken and the control computer signals the ram plate 26 and belts 24 to stop. The edge rollers 28 continue to operate normally so as to move the bottom edge of the front mailpiece 70 forward and thereby return the stack face back to its normal position. When the topple beam is no longer interrupted, the ram plate 26 and belts 24 are operated again to drive the stack of mailpieces 70 along the ramp 20.

Figure 3:
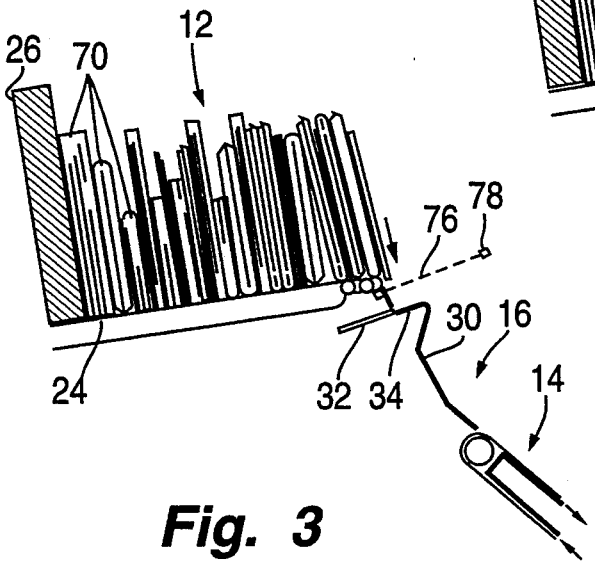
FIGS. 3–6 are schematic views showing the basic operation of transferring flats pieces from the input buffer section to the transport section.

Referring to FIGS. 3–6, there is illustrated the operation of the transfer section 16. As stated above, when a mailpiece 70 goes over the last edge roller 28 it drops downwardly onto the ledge 34 of the ledge plate 30. When the mailpiece 70 just begins to drop, as shown in FIG. 3, it crosses the beam path 76 of a through beam optical switch 78, the edge switch. This interrupts the beam so that the edge switch 78 signals the computer to immediately stop the rotation of the edge rollers 28, ramp belts 24 and pusher plate 26. This action prevents additional mailpieces 70 from being driven off of the edge rollers 28.

Figure 4:
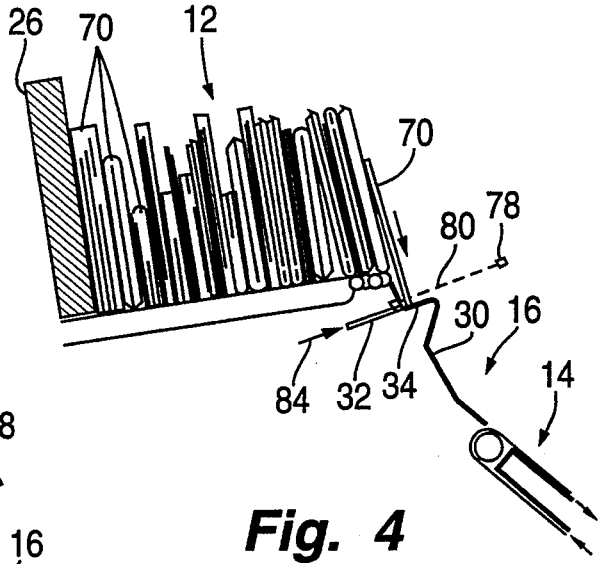
Figure 5:
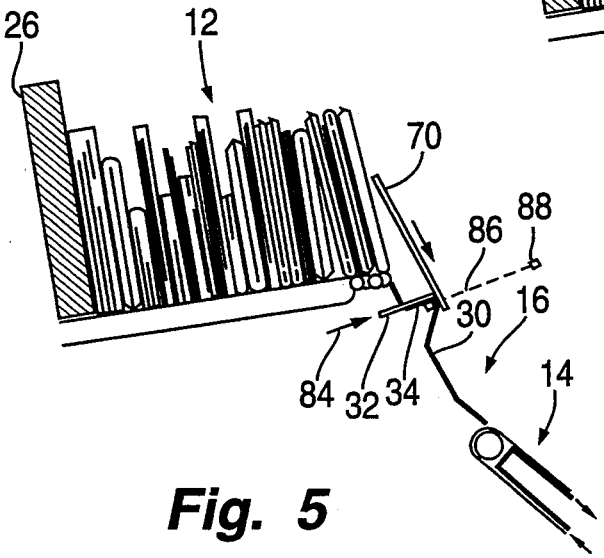
Figure 6:
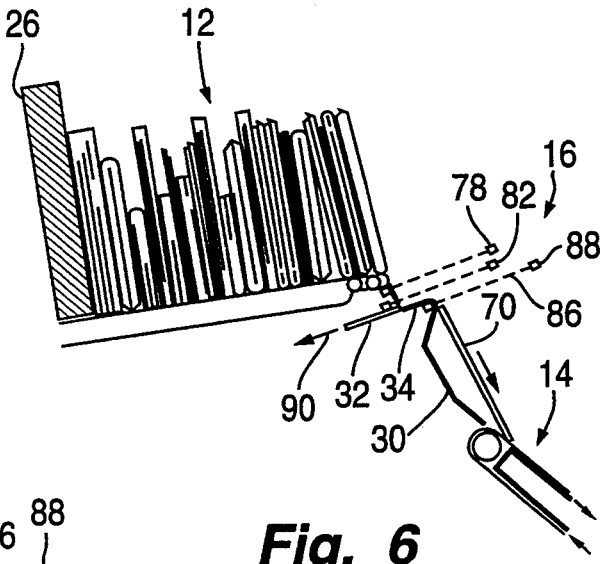

When the mailpiece 70 lands on the ledge 34, as shown in FIG. 4, it crosses the beam path 80 of another through beam optical switch 82, the top of the ledge switch. This interrupts the beam so that the top of the ledge switch 82 signals the computer to operate the pusher shelf 32. As shown in FIG. 5, the pusher shelf 32 is then moved forwardly, as indicated by the arrow 84, across the ledge 34. As shown in FIG. 6, this pushes the bottom of the mailpiece 70 off of the ledge 34 and the mailpiece 70 drops downwardly to the transport section 14. As the mailpiece 70 drops from the ledge 34 it crosses the beam path 86 of a third light switch 88, the bottom ledge sensor, which is just below the ledge 34. The bottom ledge sensor 88 informs the computer that a mailpiece 70 has cleared the ledge 34. The pusher shelf 32 is then retracted as indicated by the arrow 90 in FIG. 6.

Figure 7:
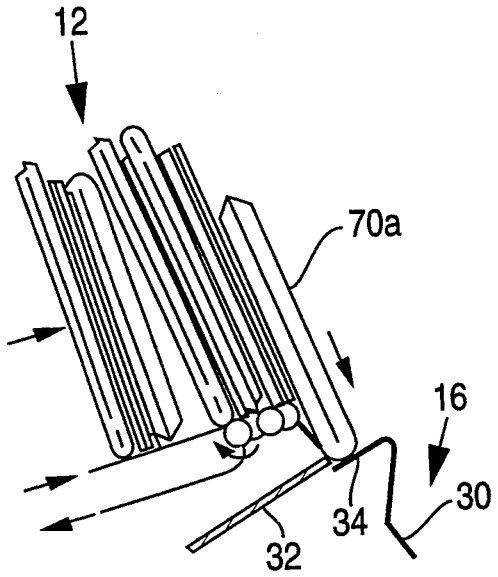
FIGS. 7–10 are schematic views similar to FIGS. 3–6 showing the operation when a second flats piece is pulled down with the leading piece.
Figure 8:
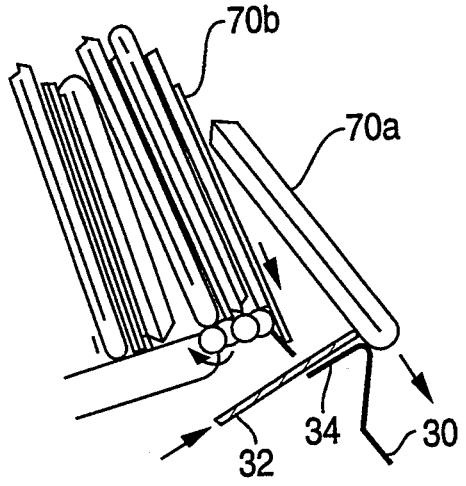
Figure 9:
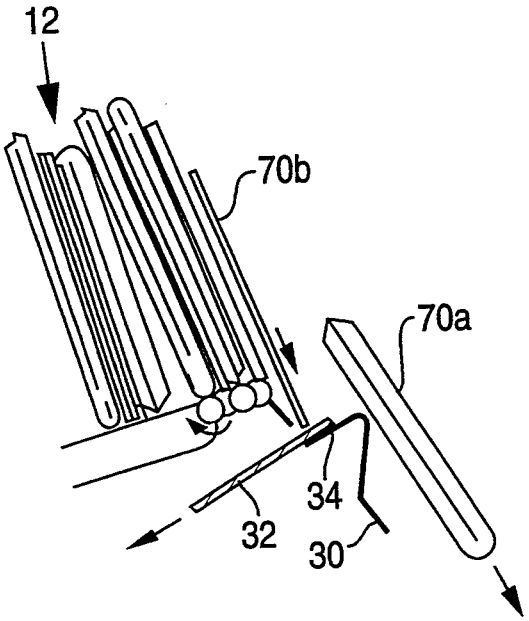

Sometimes, as a mailpiece 70 is falling from the ledge 34 it drags a second mailpiece 70 along with it from the front of the stack. The operation in such a case is shown in FIGS. 7–10. In FIG. 7 there is shown a first mailpiece **70*a* dropping onto the ledge 34 from the edge rollers 28. In FIG. 8 there is shown the mailpiece 70*a* being pushed off of the ledge 34 by the pusher shelf 32 and pulling a second mailpiece 70*b* off of the front of the stack as it drops from the ledge 34. As shown in FIG. 9, the second mailpiece 70*b* drops onto the top surface of the pusher shelf 32 which is extended across the ledge 34 to move the first mailpiece 70*a* from the ledge 34**.

Figure 10:
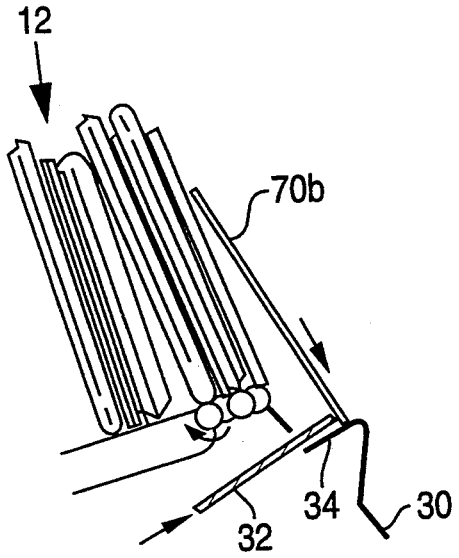

Detection of the second mail piece **70*b* is made by a through-beam sensor, the cross-beam sensor, (not shown) which directs a beam of light horizontally across the top surface of the ledge 34 from one side of the ledge plate 30 to the other side. The beam is positioned very close to the vertical wall 35 of the ledge plate 30 which extends upwardly from the ledge 34 and slightly higher than the top surface of the pusher shelf 32. Actual detection of the second mailpiece 70*b* does not take place until after the pusher shelf 32 pushes the first mailpiece 70*a* from the ledge 34 and only the second mailpiece 70*b* is on the pusher shelf 32. When the beam of the cross-beam sensor remains broken by the second mailpiece 70*b*, the computer maintains the edge rollers 28, ramp drive belts 24 and pusher plate 30 deactivated and causes the pusher shelf 32 to extend again as shown in FIG. 10 to push the second mailpiece 70*b* from the ledge 34**.

After a mailpiece 70 is pushed from the ledge 34, it free falls in a downward and slightly forward direction while remaining in an edgewise orientation until it comes into contact with the moving belt 40 of the transport section 14. The transport belt 40 is driven at a linear speed slightly less than that of the mailpieces 70 landing on it. This slight difference in speed gently coerces the mailpiece 70 to travel at the same speed as the belt 40. The decelerating force between the belt 40 and the mailpiece 70 is a result of the frictional characteristics of the two surfaces and the normal force between them aided by the vacuum applied to the mailpiece 70 from the plenum 46. The vacuum applied to the mailpieces 70 holds them to the belt 40 which then carriers the mailpieces 70 to the separation section 18.

Most of the mailpieces 70 ride down the transport belt 40 one at a time, having a gap between one mailpiece 70 and the next. However, there are times when two mailpieces 70 are pushed off of the ledge 34 at the same time and drop simultaneously onto the transport belt 40. The results of this is shown in FIG. 1 where two mailpieces **70*a* and 70*b* drop from the ledge 34 at the same time. When the two mailpieces 70*a* and 70*b* land on the belt 40, the bottom mailpiece 70*b* is caused to move at approximately the same speed as the belt 40. However, the inertia of the top mailpiece 70*a* causes it to continue moving at the original free fall velocity and possibly to continue accelerating to some degree. This causes the leading edge of the top mailpiece 70*a* to move ahead of the leading edge of the bottom mailpiece 70*b* so that the two mailpieces 70*a* and 70*b* partially overlap each other. This arrangement is referred to as "shingling", or the pieces are said to be "shingled". After a certain amount of shingling has taken place, the leading area of the top mailpiece 70*a* will also be affected by the friction of the transport belt 40 and the vacuum. From that point onward both of the two mailpieces 70*a* and 70*b* will essentially move at the same velocity with the top mailpiece 70*a* leading the bottom mailpiece 70*b* by a fixed distance. The shingled mailpieces will be separated in the separation section 18**.

Figure 11:
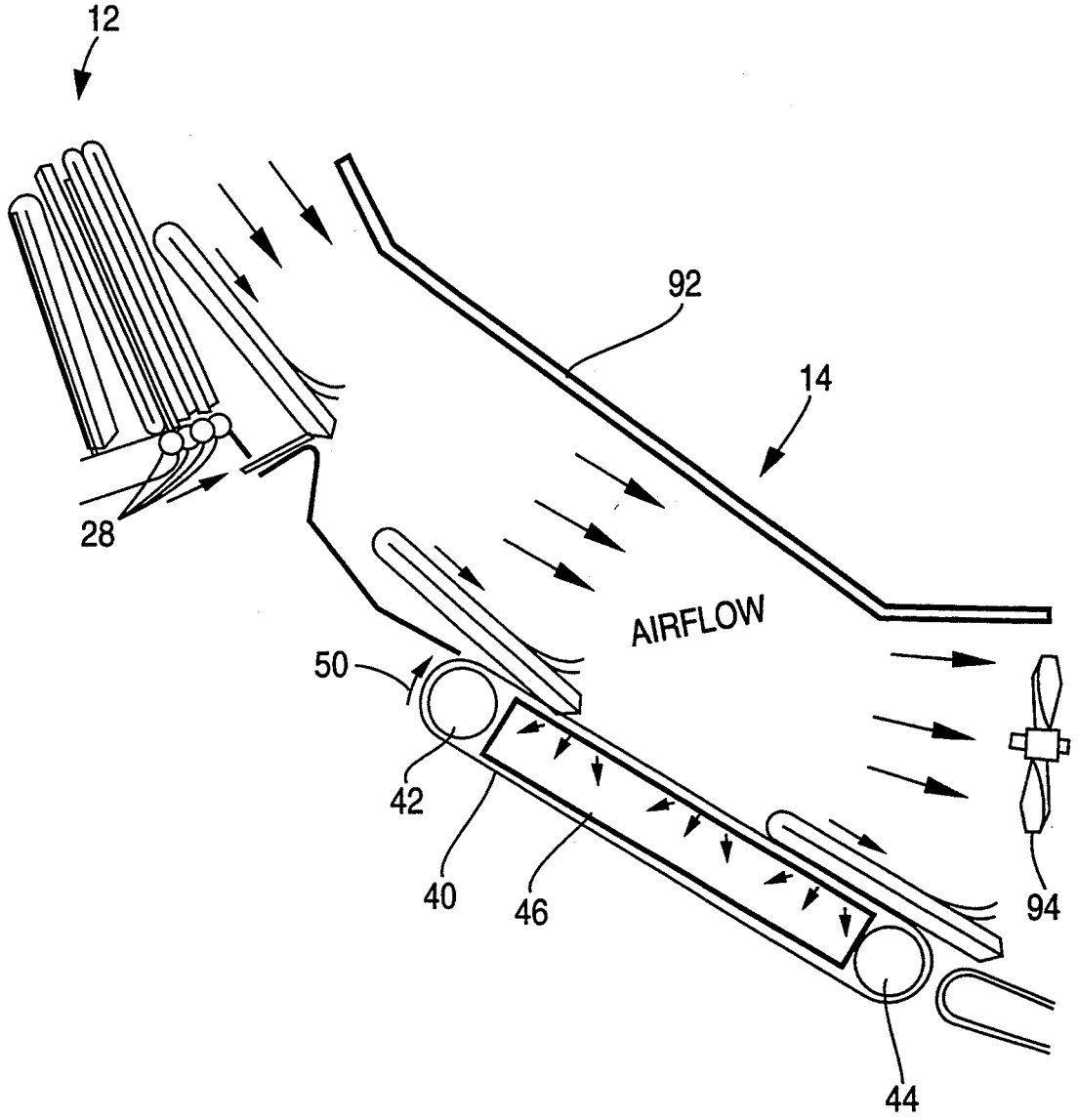
FIG. 11 is a side view of a modification of the transport section of the singulator system.

The belt 40 carries the mailpieces 70 along the transport section 14 at a relative fast speed which can cause several problems. One problem occurs when the leading edge of the moving mailpiece 70 is the opening edge of a magazine or folded flyer. In this case the apparent wind caused by the movement of the mailpiece 70 can cause the cover and top pages to blow open, which cannot be tolerated in subsequent sections of the system. Another problem is due to the aerodynamic instability of a single sheet of paper or business reply card. As these items move edgewise, aerodynamic lift can develop that causes the mailpiece to leave the surface of the belt 40 and flip and glide in an uncontrolled manner. In FIG. 11 there is shown a modification of the transport section 14 which overcomes these and other similar problems. For this purpose, the belt 40 is enclosed in a duct 92 through which an airflow is induced. The airflow is induced by a fan 94 located at the bottom end of the transport section 14 and is adapted to pull air downwardly through the duct 92 from its top end. This provides an airflow in the same direction as the movement of the mailpieces 70. By having the speed of the airflow approximately the same as that of the mailpieces 70, the apparent wind experienced by each mailpiece 70 is reduced to zero and the problems caused thereby are eliminated. It has been found that pulling the air through the duct 92 causes less turbulence than pushing it through from the top end of the duct 92.

When the mailpieces 70 reach the bottom end of the transport section 14 they are dropped into the separation section 18 which separates any shingled mailpieces 70 and carries them one at a time to further mechanism for handling the mailpieces. In the separation section 18, the separators 56 are carried in a closed path by the chain 52. When each separator 56 reaches a position close to the bottom end of the transport section 14, the ratchet pin 62 on the base 58 rides up on the cam plate 64 and disconnects the separator 56 from the chain 52. As additional separators 56 reach the front end of the cam plate 64 they are pushed up against the previous separator 56 and the separators stack up just prior to reaching the bottom of the transport section 14. The mechanism, previously described but not shown, grabs the leading separator 56 from the stack and carries it at a speed faster than the chain speed past the bottom end of the transport section 14. As the separator 56 passes under the transport section 14, a mailpiece 70 drops from the belt 40 and onto the leading surface of the vane 60 of the separator 56. The mailpiece 70 slides down the vane 60 and is carried upward by the separator 56 to the sliding gate 66 where it is dropped downwardly to the transport device 68. The transport device 68 carries the mailpieces 70 to additional handling apparatus, such as sorting machines and the like.

Figure 13:
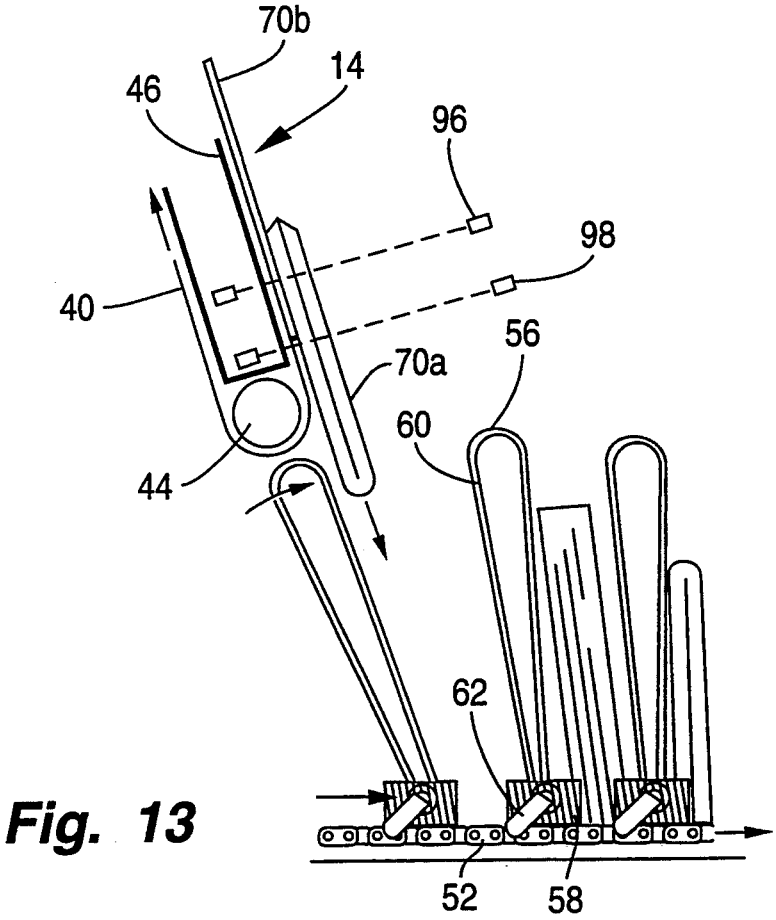
FIG. 13 is a schematic view illustrating the operation of the separation section.

As shown in FIG. 13, at the bottom end of the belt 40 of the transport section 14 are a pair of spaced through beam switches 96 and 98, each of which directs a beam of light onto the belt 40. The switches 96 and 98 detect the presence of a mailpiece 70 and measures its velocity. This information is used to control the mechanism for moving the separators 56 quickly across the bottom end of the transport section to ensure that there is a separator 56 at the bottom end of the transport section 14 when a mailpiece 70 reaches that point. FIG. 13 also shows a pair of shingled mailpieces **70*a* and 70*b* being delivered by the belt 40 to the separation section 18. The leading mailpiece 70*a* of the shingled pair is first picked up by a separator 56 and carried away before the second mailpiece 70*b* reaches the end of the belt 40. By this time, the next separator 56 has been moved up to catch the second mailpiece 70*b* and thereby carry it along the separation section 18. Thus, the separation section 18 picks up the individual mailpieces 70, separates them when necessary, and carries the mailpieces 70** one at a time to the next apparatus for handling the mailpieces.

Figure 14:
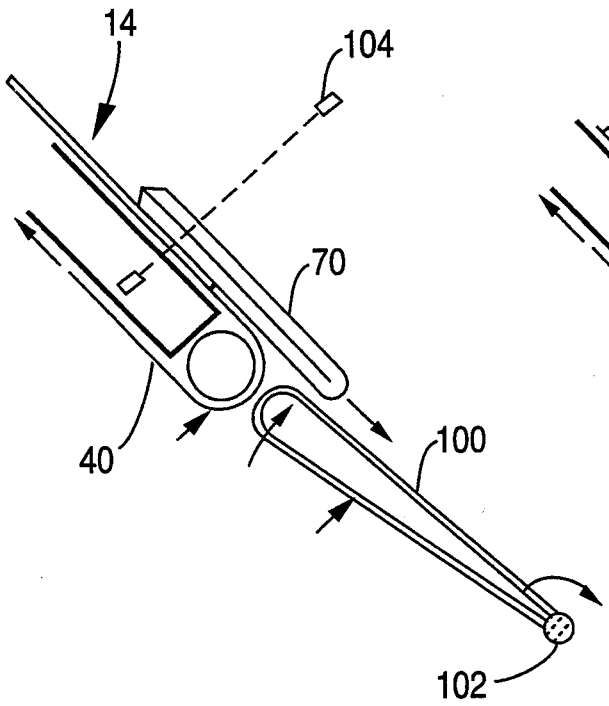
FIGS. 14–17 are schematic views illustrating a modification of the separation section and its operation.
Figure 15:
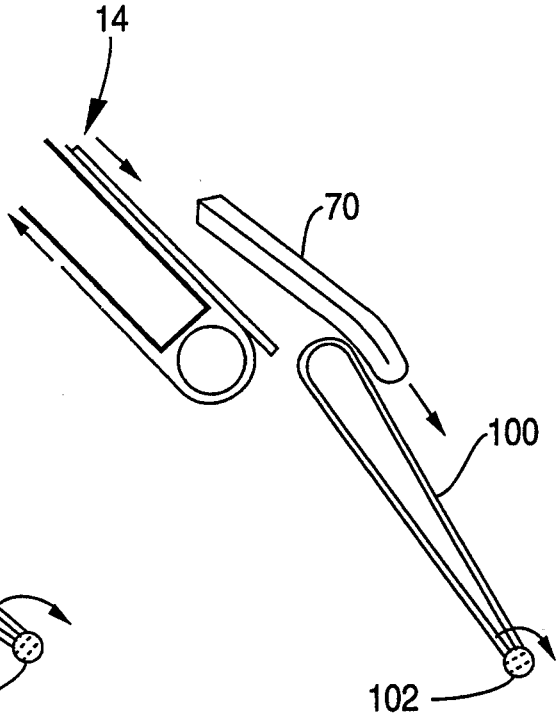
Figure 16:
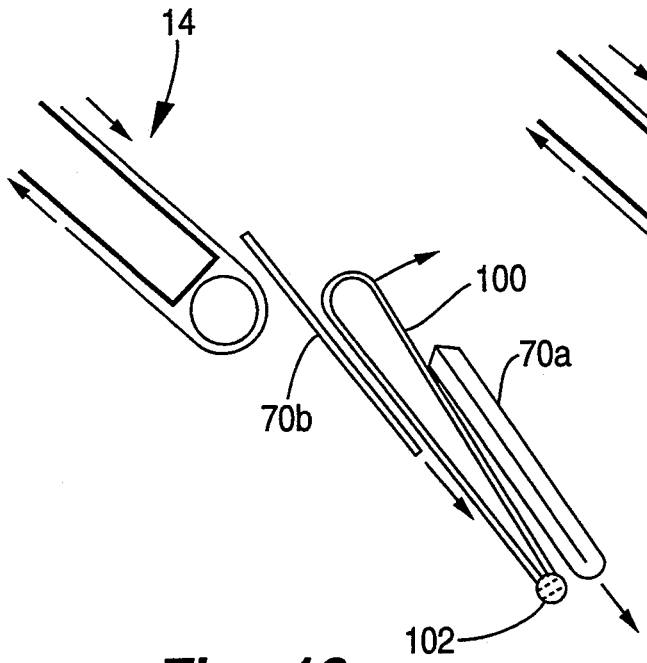
Figure 17:
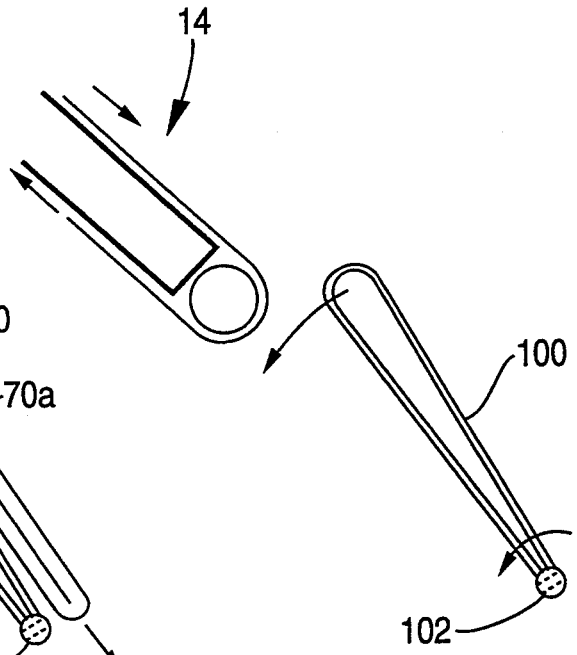

Referring to FIGS. 14–17, there is shown another form of separation section which can be used in the singulation system 10. The separation section includes a single separator vane 100 mounted at the end of the transport section 14 along substantially the plane of the belt 40. The bottom end of the vane 100 is mounted on a shall 102 which is rotated back and forth to pivot the vane 100 back and forth across the end of the transport section 14. As shown in FIG. 14, a single thru-beam switch 104 is positioned at the end of the belt 40 so as to detect the presence of a mailpiece 70 on its way to the separation vane 100. When the mailpiece 70 reaches the end of the belt 40, the vane 100 is positioned in alignment with the belt 40 so that the mailpiece 70 passes over the upper surface of the vane 100. As shown in FIG. 15, the vane 100 is pivoted upwardly to pick up the mailpiece 70 and allow it to slide down the vane 100. The mailpiece 70 slides down the vane 100 and drops onto a ramp, not shown, below the vane 100 and which delivers the mailpiece 70 to the next apparatus. As shown in FIG. 17, the vane 100 is then pivoted back across the end of the transport section 14 so as to be in position to pick up the next mailpiece 70. However, if there is a pair of shingled mailpieces, as shown in FIG. 16, the leading mailpiece **70*a* is picked up on the front surface of the vane 100 and drops therealong to the ramp whereas the second mailpiece 70*b* drops behind the vane 100 to the ramp. Thus, the two mailpieces 70*a* and 70*b*** are completely separated.

Figure 19:
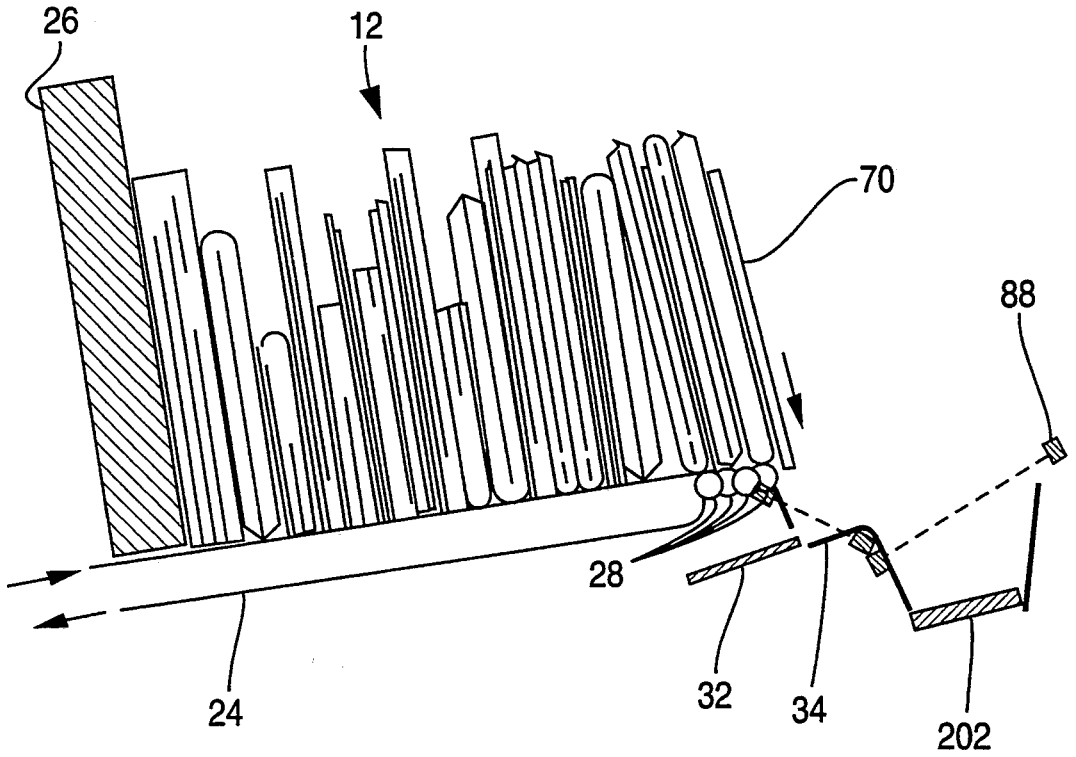
FIG. 19 is a schematic side view of a second embodiment of the singulator system of the invention.
Figure 20:
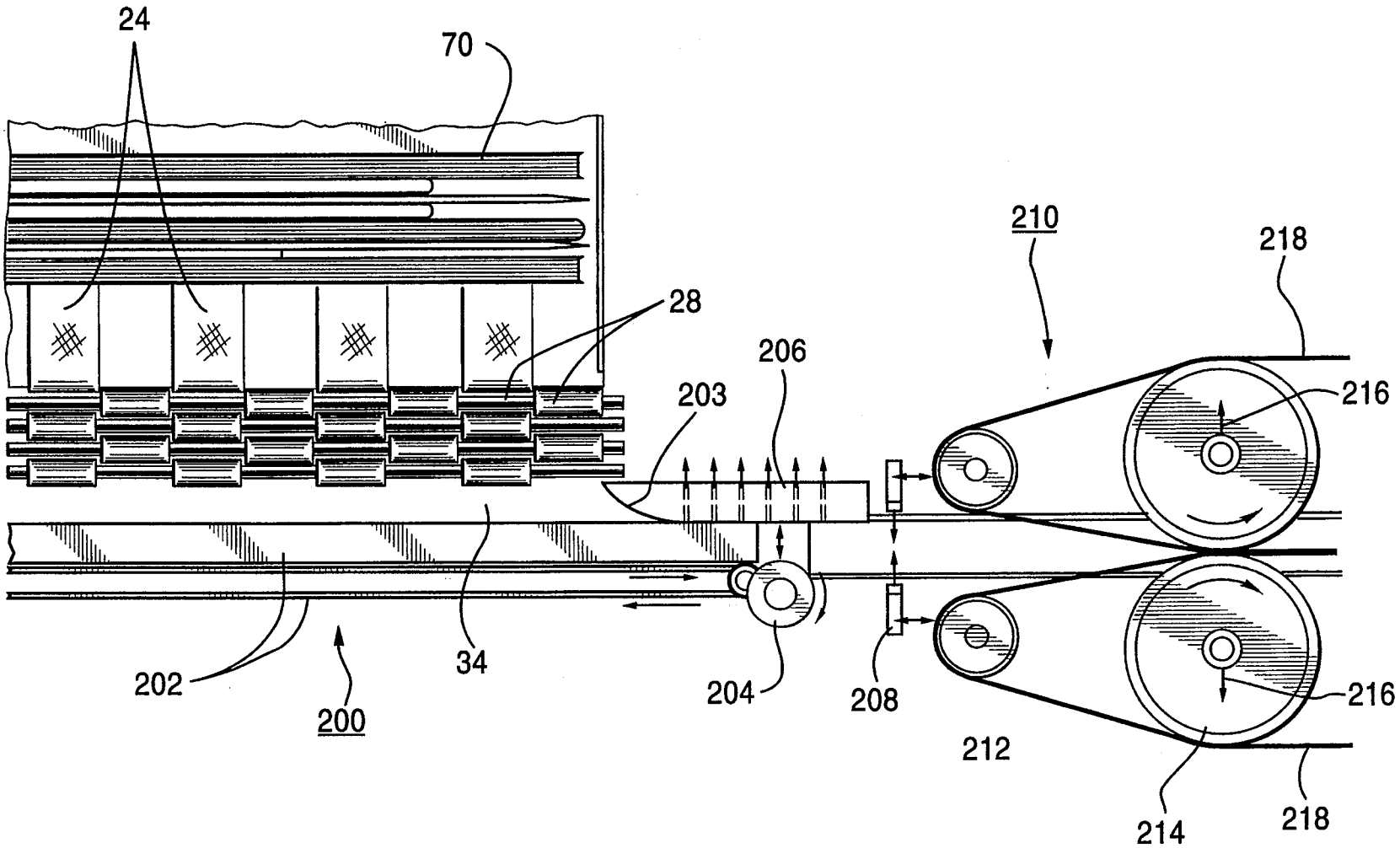
FIG. 20 is a schematic top view of the second embodiment of the singulator system of the invention.

A second embodiment of the flats singulation system of the invention is shown in FIGS. 19 and 20 which are schematic side and top views respectively. The input buffer section is the same as that for the first embodiment. The transfer section 16 is substantially the same as the transfer section for the first embodiment and differs only in that the ledge plate 30 extends downward a shorter distance, typically only about 3.8 centimeters. The transport section 14 of the first embodiment is not present with its function in effect combined into a new separation section 200. Separation section 200 comprises an endless transport belt 202, typically a single belt, extending between and around a pair of spaced drive pulleys, not shown. Flats drop directly onto the belt 202 from the pusher 30 in the upright position and are then carried away in a direction which is preferably substantially orthogonal to the direction of motion of the flats in the input buffer section 12.

This system also includes the topple sensor, the edge sensor, the ledge switch and the bottom ledge sensor 88 as shown in FIGS. 2–6. For clarity sake only the bottom ledge sensor 88 is shown in FIG. 19.

Flats then are transported on the belt 202 between a combination of an intermittent pinch roller 204 and a retarding surface 206. The retarding surface 206 may be a vacuum plate. The purpose of the roller 204 and retarding plate 206 is to separate flats that have become shingled on the belt 202. The intermittent pinch roller 204 provides a series of impulses to the leading flat of a shingled pair increasing its speed while the vacuum plate retarding surface 206 provides additional friction to the lagging flat of the shingled pair, thereby separating the shingled pair. The vacuum plate retarding surface 206 typically provides a vacuum of a few inches of water. The intermittent pinch roller 204 and a vacuum plate retarding surface 206 comprise means for separating shingled flats. The surface 203 of the vacuum plate retarding surface 206 provides a transition between the ledge and an upright supporting surface for the mailpieces as they move along the belt 202.

Grippers 208 then close on each flat and carry it forward into a pinch belt flat piece buffer and take-away assembly 210. The assembly 210 comprises a stationary roller 212 and a movable idler pinch roller 214, typically spring loaded, which can move in the direction indicated by the arrows 216 to adjust for the varying thickness of the mailpieces. A pair of endless belts 218 driven by a pulley system, not shown, grips the mailpieces in succession and transports them from the singulation system to the machine operator or other desired location. The endless belts 218 are driven by a two horsepower maximum servo motor controlled by the system operator.

Any surface which must grip a mailpiece to move it such as the intermittent pinch roller 204, the grippers 208 and the endless belts 218 are coated with, or comprised of, a high friction material, typically rubber.

Figure 21:
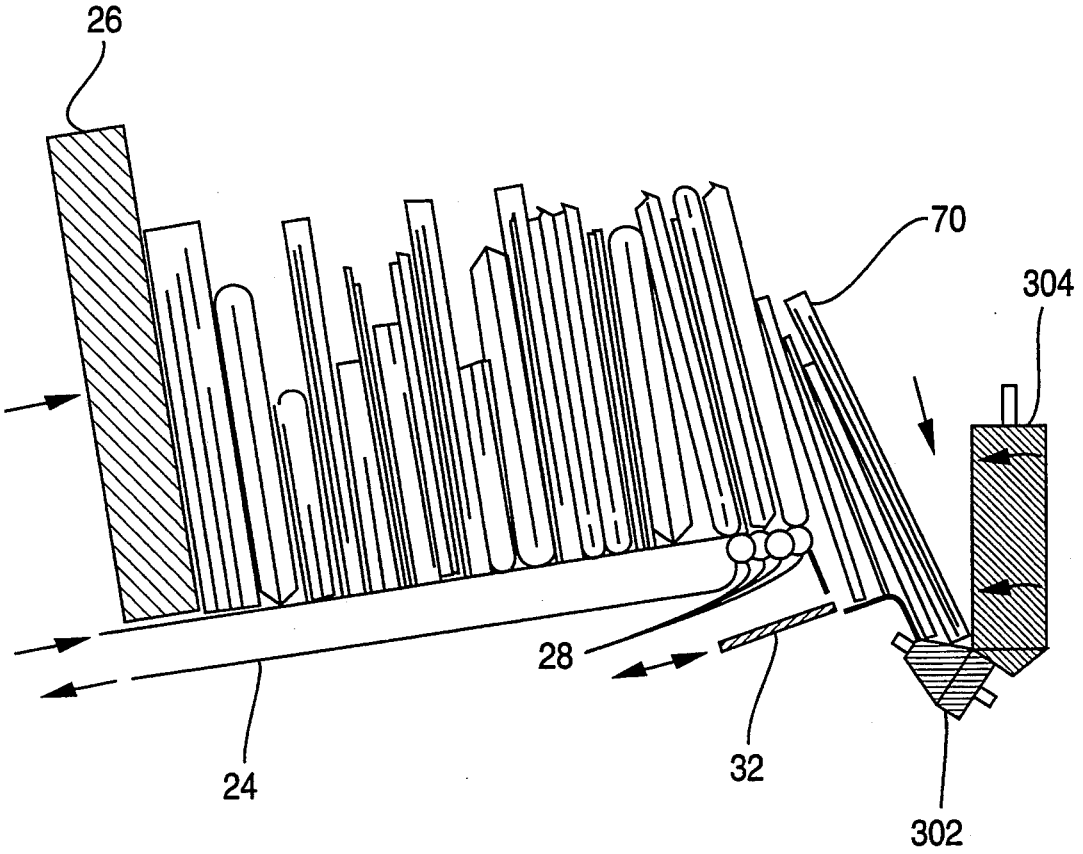
FIG. 21 is a schematic side view of a third embodiment of the singulator system of the invention.
Figure 22:
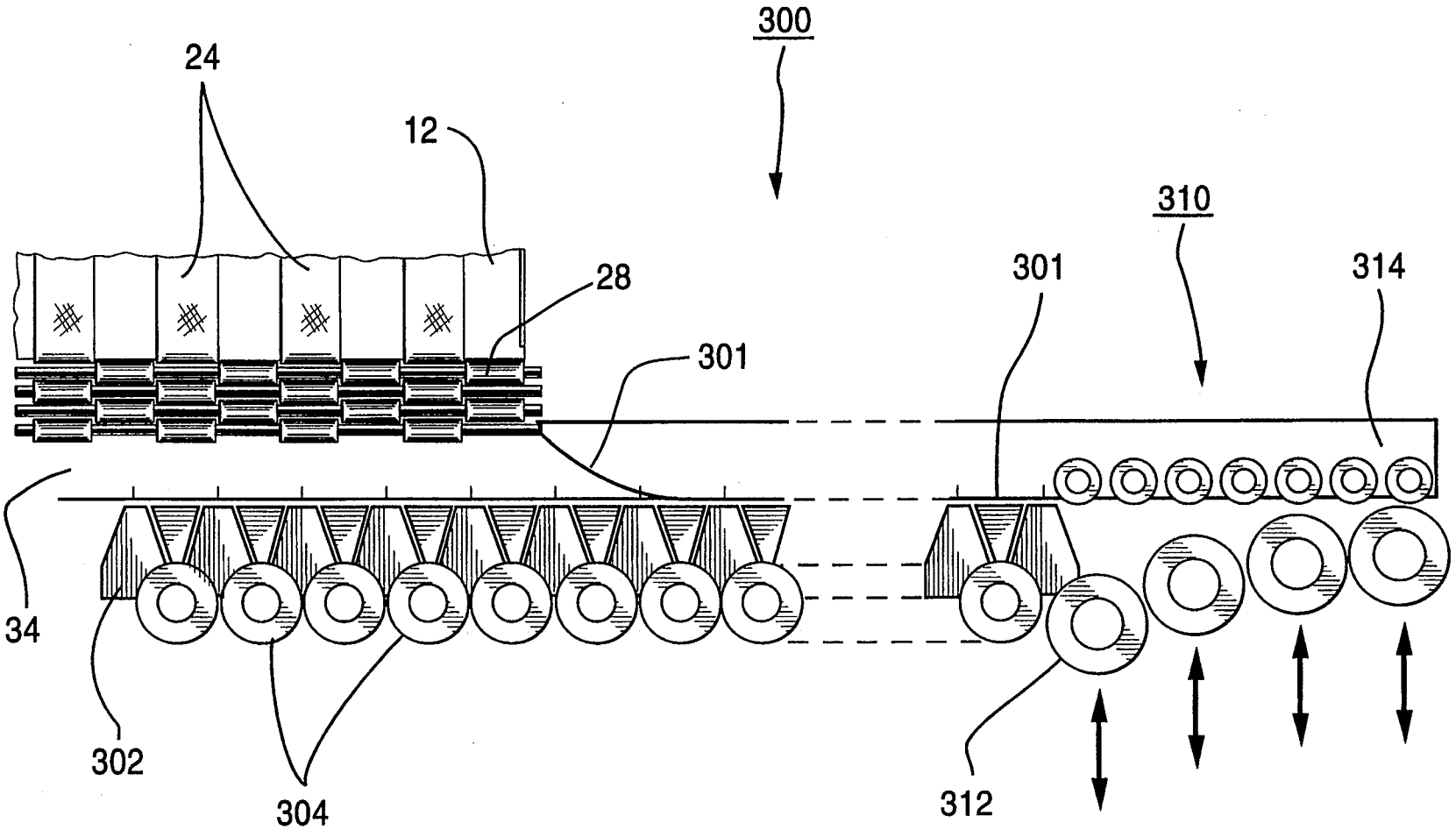
FIG. 22 is a schematic top view of the third embodiment of the singulator system of the invention.

A third embodiment of the flats singulation system of the invention is shown in FIGS. 21 and 22 which are schematic side and top views respectively. The input buffer section and transfer section are the same as that for the second embodiment except for the addition of a guide plate 301.

Embodiment 300, as shown in FIGS. 21 and 22, differs principally from the second embodiment in the structure of the separation section. The endless transport belt 202 of FIGS. 19 and 20 is replaced by a series of tapered rollers 302 onto which the mailpieces drop and a series of cylindrical rollers 304 to support and guide the mailpieces. Support plate 301 provides a transition between the ledge and an upright supporting surface for the mailpieces as they move along the rollers. The tapered rollers 302 are between about 3.2 and 3.8 centimeters maximum diameter and between about 1.6 and 1.9 centimeters minimum diameter. The cylindrical rollers 304 are between about 2.5 and 3.8 centimeters in diameter.

The array of tapered rollers 302 are arranged to drive against the bottom edges of the small mail groups that have dropped from the ledge. The rollers push this on-edge mail toward the right in FIG. 22. The tapered rollers have the effect of moving mail relatively faster on the larger diameter end of the rollers. This tends to increase the amount of shingling of the mail pieces from a given group. In other words if a small group of flat pieces is placed on the left end of the tapered rollers in FIG. 22, the right end of each piece being lined up with one another, they will be spread out to some degree by the time they have been transported to the end of the tapered rollers. Also, the rotational velocity of the tapered rollers might not be spatially constant. An increase of the roller velocity from left to right will also help to spread the flat pieces out.

The cylindrical rollers 304 serve as a front guide or retainer for the mail moving along the tapered rollers. Each of the cylindrical rollers 304 can be run at a higher surface speed than the nearest tapered roller. This action will extend the functioning of the tapered rollers; the increased surface speed will tend to spread mail out as it moves along.

The support plate is preferably composed of a low friction material such as a polished metal.

The combination 310 of an array of pinch rollers 312 and a retardation plate with retarding rollers 314 at the exit end of the tapered rollers 302 are designed to peel apart any remaining doubles and are the means for providing the retardation for flat piece separation. The set of pinch rollers 312 shown in the FIG. 22 are preferably used in place of the intermittent pinch roller 204 shown in FIG. 20. The intermittent pinch roller 204 limits the cycle time of the machine because of the time necessary to actuate it and move it into position. The pinch rollers 312, however, are arranged so they will accept the thickest mail piece, and they do not need to be actuated into position since the tapered spacing between the pinch rollers 312 and the retarding rollers 314 eventually reach a spacing that they will engage a flats piece no matter what its thickness. Therefore, the cycle time of the singulation system can be much faster. The pinch rollers are spring loaded so that they do have the flexibility to move in the direction indicated in FIG. 22. The retardation plate consists of a series of high friction rollers that, when they are permitted to free-wheel, create a low friction surface for the flats to move across. Then, by providing a braking torque to the rollers, the arrangement very rapidly becomes a flats-retarding surface. The retarding rollers preferably are located behind the support plate and extend through openings in the support plate to contact the flats pieces. The pinch rollers 312 are typically about 2.5 centimeters in diameter and the retarding rollers 314 are about 1 centimeter in diameter.

The third embodiment also includes the fast-moving take away assembly 210, shown in FIG. 20. Mail is pulled into the fast-moving take away assembly 210 once it leaves the pinch rollers. The mail leaving the pinch rollers should, in most cases, already be singulated. If the mail has not been singulated by this point in the system, it will at least be shingled. The pinch belts will move at a much higher speed than the pinch rollers. Therefore, when the leading edge of a singulated, or shingled flat piece enters the throat of the pinch belts, it is rapidly pulled out of the pinch rollers and away from any other flat pieces that may be there.

Figure 23A:
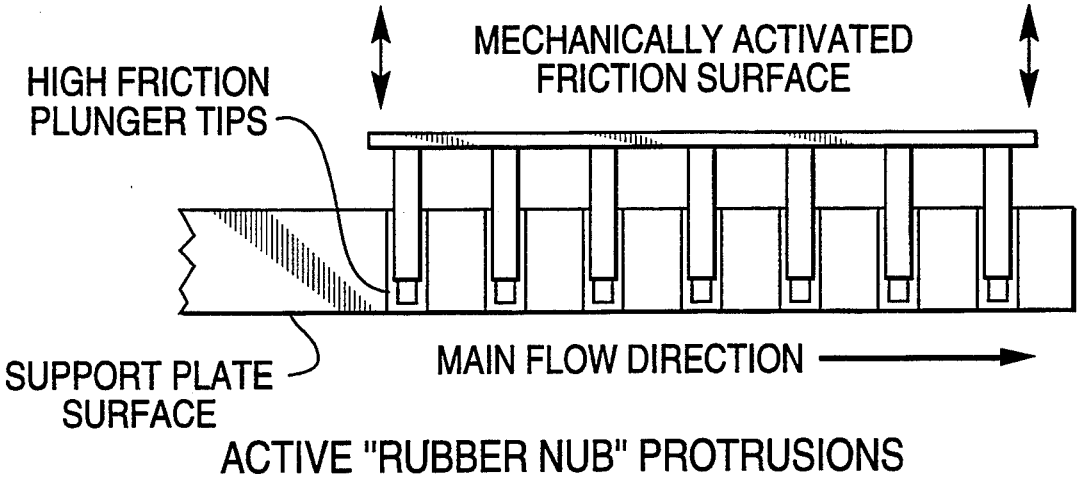
FIG. 23A, B and C are schematic side views of three different means for providing the retardation for mailpiece separation.
Figure 23B:
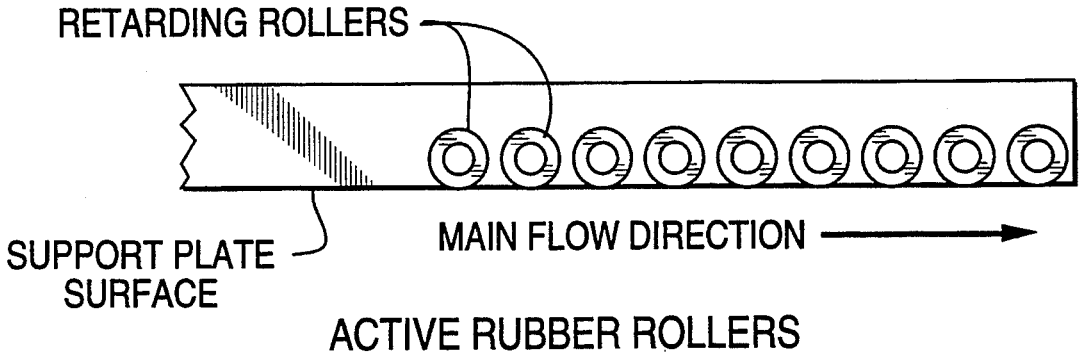
Figure 23C:
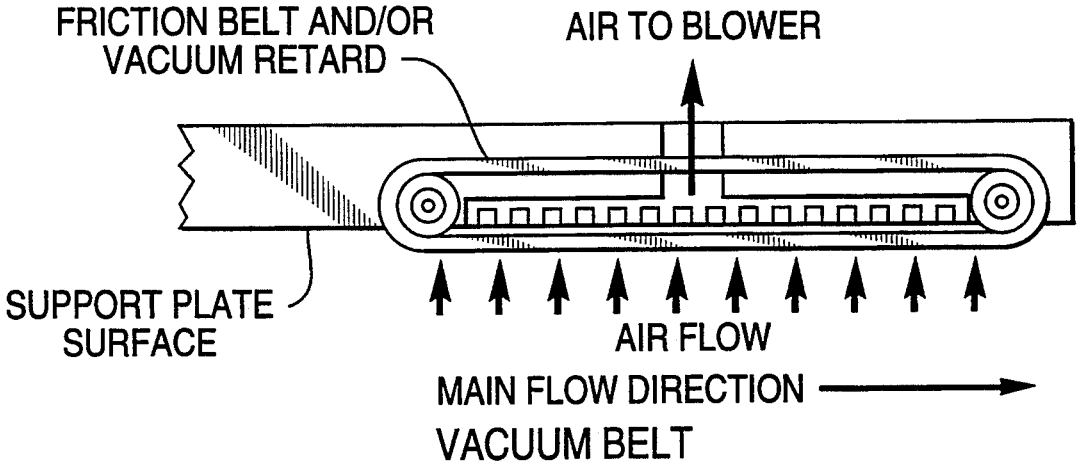

In FIG. 23 three different means for providing the retardation for flat piece separation are shown. The active rubber roller shown in FIG. **23*b*** and described with reference to the third embodiment is preferred for its simplicity and reliability.

In operation, the apparatus is typically controlled by a computer up to the take away assembly 210. The computer continually monitors the system, working backwards from the take away assembly and causes the system to advance the flats each time an empty position is found.

The invention has been described in terms of several different embodiments but is not limited thereto. Modifications to the described embodiments may be made which remain within the scope of the invention. For example, while the invention has been described in terms of handling flats mail, it is clear to one of ordinary skill that the apparatus of the invention can be used to separate and present for further processing any flats type objects.

Thus, there is provided by the present invention a flats separator system in which individual pieces are removed from a stack and delivered one at a time to additional handling apparatus. The system handles various sizes, kinds and types of flats which can be mixed up in the stack. In the event that two pieces are removed from the stack either at the same time or close together, the system separates the pieces and delivers them one at a time at the end of the system.

What is claimed is:

1. An apparatus for singulating flats comprising:

a substantially horizontal input buffer section including a ramp for supporting a stack of flats with the flats being seated on one edge, said buffer section including means for moving said stack of flats along said ramp to a front end of the ramp;

a transfer section at one end of the input buffer section, said transfer section including a plurality of parallel edge rollers extending across the front end of the ramp and being arranged along a plane no higher than the level of the top of the ramp, and means for rotating said edge rollers so that when the front flat in the stack reaches the front end of the ramp, the rollers contact the bottom edge of the flat and move the flat away from the stack and over all of the rollers and allow the flat to drop vertically downwardly; and a separation section below the transfer section and adapted to receive the flats from the transfer section and carry the flats one at a time away.

2. The apparatus of claim 1 in which the ramp extends upwardly toward the front end of the ramp at a slight angle with respect to the horizontal.

3. The apparatus of claim 2 in which the means for moving the stack of flats along said ramp includes a ram plate extending vertically from the top surface of the ramp and adapted to engage the back of the stack of flats on the ramp and means for moving the ram plate along said ramp.

4. The apparatus of claim 3 in which the means for moving the stack of flats along said ramp includes an endless belt having a portion extending over and along the top surface of the ramp, said stack of flats adapted to be seated on the belt, and means for moving said belt.

5. The apparatus of claim 2 in which each of the edge rollers has alternating sections of different diameters with the larger diameter sections of each edge roller being between two larger diameter sections of adjacent edge rollers so that they overlap each other.

6. The apparatus of claim 5 in which the transfer section includes a ledge plate extending downwardly from the edge rollers and having a substantially horizontally extending ledge positioned slightly below the edge rollers so that the flats drop from the edge rollers onto the ledge, and a pusher shelf adapted to move across the ledge and push a flat therefrom.

7. The apparatus of claim 6 in which the ledge plate has an opening therethrough slightly above the ledge and the pusher shelf is adapted to move back and forth across the ledge through the opening.

8. The apparatus of claim 2 further comprising a transport section below said transfer section and adapted to receive said flats as they drop from the transfer section and carry the flats downwardly to the separation section.

9. The apparatus of claim 8 in which the transport section includes an endless belt having a portion extending substantially downwardly from the transfer section and adapted to receive the flats from the transfer section and vacuum means for holding the flats to the belt.

10. The apparatus of claim 9 including a duct surrounding the belt and means for creating a flow of air through the duct and over the belt in the direction of the movement of the belt.

11. The apparatus of claim 8 in which the separation section comprises a flats buffer and take away assembly.

12. The apparatus of claim 8 in which the buffer and take away assembly comprises a stationary roller, a movable idler pinch roller and an endless belt passing over each roller.

13. The apparatus of claim 11 in which the separation section includes a substantially vertically extending vane movable across the bottom end of the transport section and adapted to receive individual flats from the transport section and move them one at a time away from the transport section.

14. The apparatus of claim 13 in which the separation section comprises an endless drive chain having a portion extending substantially horizontally across the bottom end of the transport section, a plurality of vanes mounted on said chain for movement therewith, and means for individually moving said vanes rapidly across the bottom end of the transport section to pick up a flat from the transport section and carry it away therefrom.

15. The apparatus of claim 2 in which the separation section comprises a flats buffer and take away assembly.

16. The apparatus of claim 15 in which the buffer and take away assembly comprises a stationary roller, a movable idler pinch roller and an endless belt passing over each roller.

17. The apparatus of claim 15 in which the separation section further comprises an endless belt adapted to receive individual flats from the transfer section and move them away from the transfer section.

18. The apparatus of claim 17 in which the separation section further comprises means for separating adjacent flats on the belt.

19. The apparatus of claim 17 in which the means for separating adjacent flats on the belt comprises the combination of an intermittent pinch roller and a retarding surface arranged on opposite sides of the belt.

20. The apparatus of claim 13 in which the retarding surface is a vacuum plate.

21. The apparatus of claim 17 in which the means for separating adjacent flats on the belt comprises the combination of a plurality of pinch rollers and a retarding surface.

* * * * *